United States Patent [19]

Wehmeyer et al.

[11] 4,427,093

[45] Jan. 24, 1984

[54] LOCKING DEVICE

[75] Inventors: Donald T. Wehmeyer, Roselle; Ronald W. Barnhart, Elmhurst, both of Ill.

[73] Assignee: Economy Engineering Company, Bensenville, Ill.

[21] Appl. No.: 220,821

[22] Filed: Dec. 29, 1980

[51] Int. Cl.[3] ..... B66B 9/20; E04G 1/22

[52] U.S. Cl. ..... 182/141; 182/63; 182/210; 182/208; 187/9 E; 187/11

[58] Field of Search ..... 187/9 E, 10, 11; 182/208, 210, 63, 141, 148, 62.5

[56] References Cited

U.S. PATENT DOCUMENTS

| | | | |
|---|---|---|---|
| 459,613 | 9/1891 | Newman . | |
| 1,112,122 | 9/1914 | Detrick . | |
| 2,499,091 | 2/1950 | Brubaker . | |
| 2,595,120 | 4/1952 | Barnes . | |
| 2,987,140 | 6/1961 | Olson | 187/9 |
| 3,187,842 | 6/1965 | Quayle | 187/9 |
| 3,561,568 | 2/1971 | Hansen | 187/9 |
| 3,621,935 | 11/1971 | Bode | 182/68 |
| 3,737,007 | 6/1973 | Herrell | 182/141 |
| 4,015,686 | 4/1977 | Bushnell | 182/148 |
| 4,155,428 | 5/1979 | Hansen | 187/9 |

*Primary Examiner*—Reinaldo P. Machado

*Attorney, Agent, or Firm*—Willian, Brinks, Olds, Hofer, Gilson & Lione, Ltd.

[57] ABSTRACT

An automatic locking device is provided for a telescoping work platform that includes: a base frame, a middle frame and a platform frame, the locking device comprises a first sliding member mounted in the middle frame, a first notch in the base frame for receiving said first sliding member and a first cam on said platform for disengaging said first member from said first notch, it also comprises a second sliding member mounted to the middle frame, a second notch in the base frame for receiving said second member and a second cam on said base frame for disengaging said second member from said second notch.

21 Claims, 12 Drawing Figures

FIG. 7
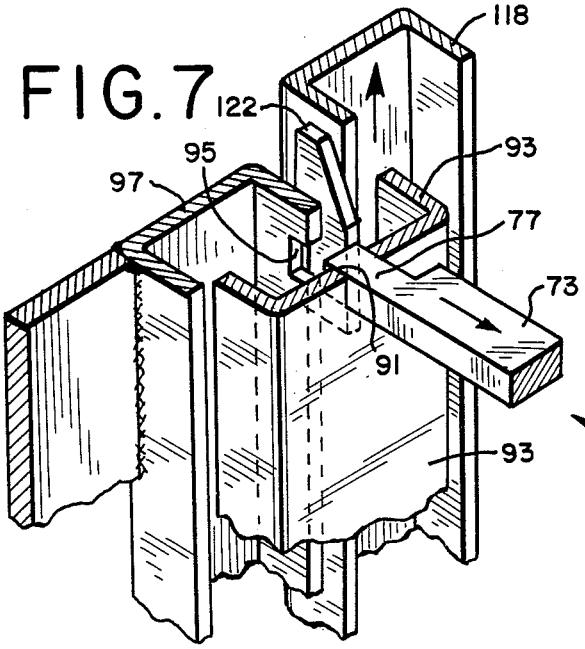
FIG. 8
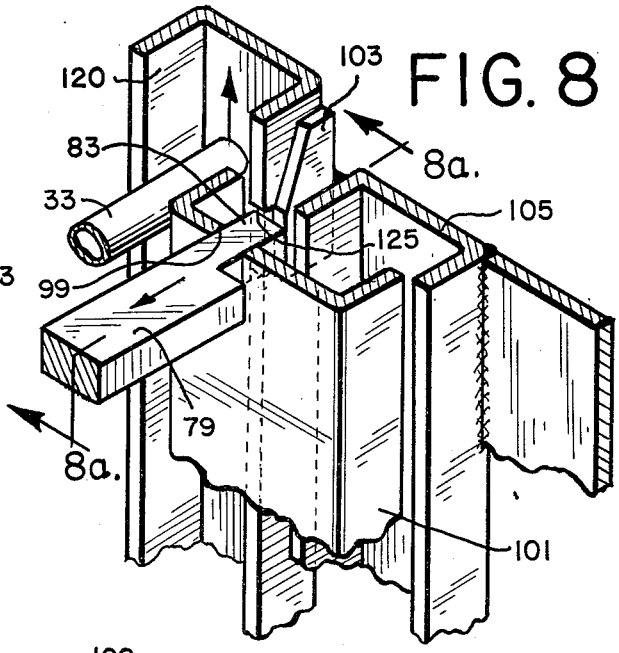
FIG. 10
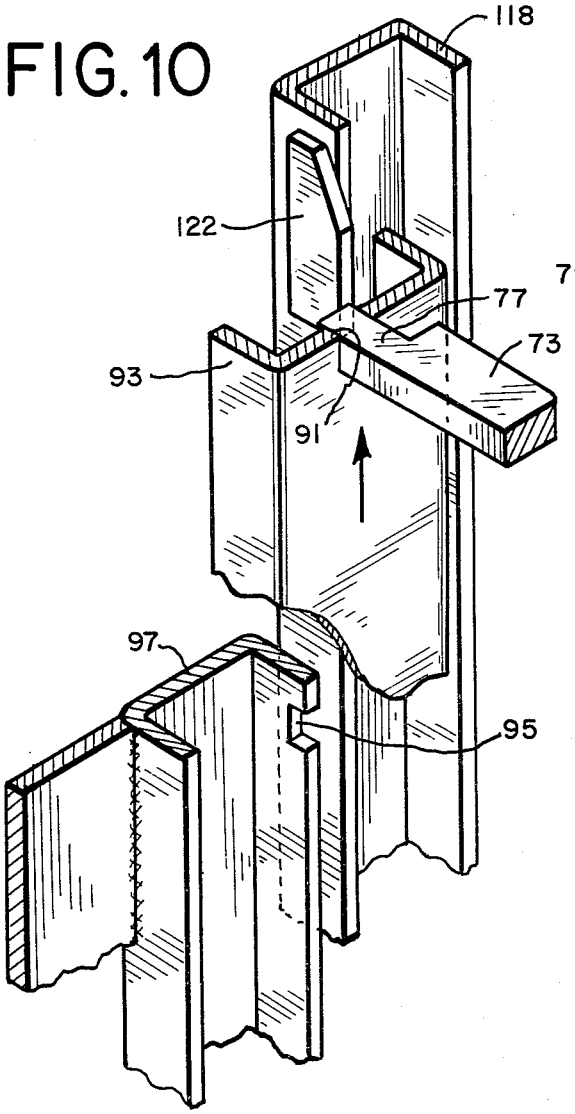
FIG. 9
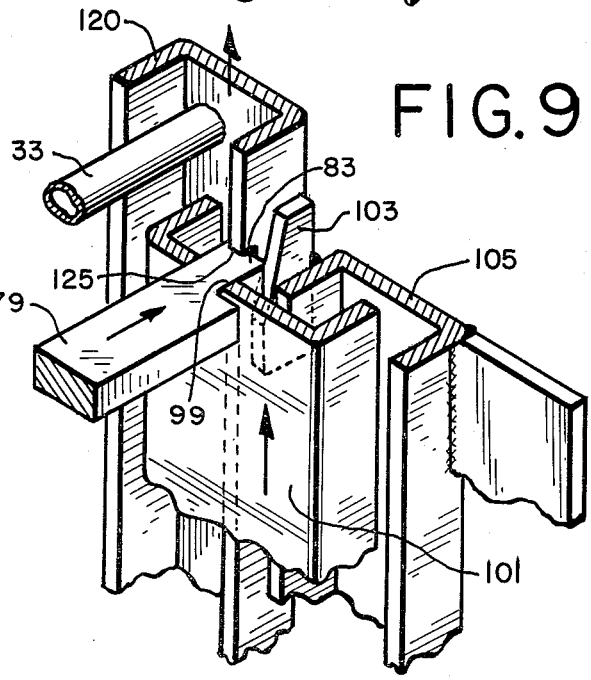
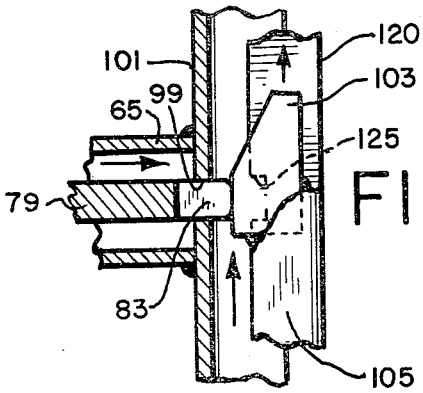
FIG. 8a

LOCKING DEVICE

BACKGROUND OF THE INVENTION

This invention relates to telescoping work platforms. In particular, it relates to locking mechanisms for telescoping work platforms that are extended and retracted by hoist cables.

The conventional telescoping work platforms generally include three frames (stages): a base frame, a middle frame and a platform frame. The frames are operatively interconnected such that the middle frame can be raised above the stationary base frame and the platform frame can be raised above the middle frame. The raising and lowering of frames to their fully nested postions is accomplished by reeling a hoist cable onto a drum by means such as a crank. The hoist cable, anchored to the lower end of the platform frame, extends through a pulley mounted at the upper end of the middle frame and through a pulley near the top of the base frame to the drum.

When the work platform is in a fully nested position, the reeling of the hoist cable onto the drum causes the platform frame to lift. The platform frame is lifted until it comes in contact with stops which prevent further upward movement. The subsequent reeling of the hoist cable then causes the lifting of the middle frame until it reaches its fully extended position defined by appropriate stops.

To retract the platform from its fully extended position, the crank is rotated to release the hoist cable from the drum. As the cable is released, the middle frame is lowered, while the platform frame remains in a fixed position with respect to the middle frame. Once the middle frame reaches its fully nested position, a further release of the cable causes the lowering of the platform frame until it reaches its fully nested position.

When the work platform is in a fully or even partially extended position, the platform frame is at a relatively high elevation. Accordingly, it is essential to the safety of those using the work platform that the frames of the platform do not accidentally slip or fall from their fully extended positions.

A platform may be equipped with safety chains, the links of which are engaged by locking means in the event the hoist cable breaks. The safety chains prevent the platform from falling in the event of the broken cable. However, another problem may result when the owner or user of the platform neglects to properly maintain the platform. Specifically, a failure to maintain the platform can cause a build-up of rust and dirt along the guide tracks on which the frames are raised and lowered. Such build-up can cause premature raising or lowering of the middle frame. The premature raising or lowering of the middle frame creates an unstable condition where the weight of the user can cause an extended or partly extended sliding frame to fall to its fully nested position.

Accordingly, it is essential that the stages be lowered and raised in proper sequence. If the owner or user of the platform follows the instructions in the operator instruction and maintenance manual the proper sequence is assured. Many owners or users, however, ignore and elect not to follow instructions and allow the guide tracks to rust and to accumulate a build-up of particles. The neglect can hinder the proper sequencing of staging.

The present invention provides a device for telescoping work platforms that alleviates problems and conditions caused by owner's or user's failures to maintain the work platform.

One object of the present invention is to provide a device which compensates for owner's or user's failures to properly maintain the work platform and prevents improper sequencing of the platform which is not properly maintained.

A further object of the present invention is to provide a device for the work platform which is reliable and which requires minimal maintenance.

Still another object of the present invention is to eliminate unstable conditions in raising or lowering work platforms even if they are not properly maintained.

Still another object of the present invention is to provide an automatic device which need not be specially activated by the user and which does not inconvenience the user.

Other objects of the present invention become apparent to those skilled in the art upon studying this disclosure.

BRIEF DESCRIPTION OF DRAWINGS

FIG. 7 is a partial-perspective view of the first end of the locking device of FIG. 3 unlocked by a cam.

FIG. 8 is a partial-perspective view of the second end of the locking device of FIG. 3 unlocked by a cam.

FIG. 8*a* is a cross-sectional view of the locking device shown in FIG. 8 taken along lines 8*a* thereof.

FIG. 9 is a partial-perspective view of the second end of the locking device shown in FIG. 3 being unlocked by a cam.

FIG. 10 is a partial-perspective view of the first end of the locking device of FIG. 3 unlocked by a cam.

BRIEF DESCRIPTION OF THE INVENTION

Figure 1:
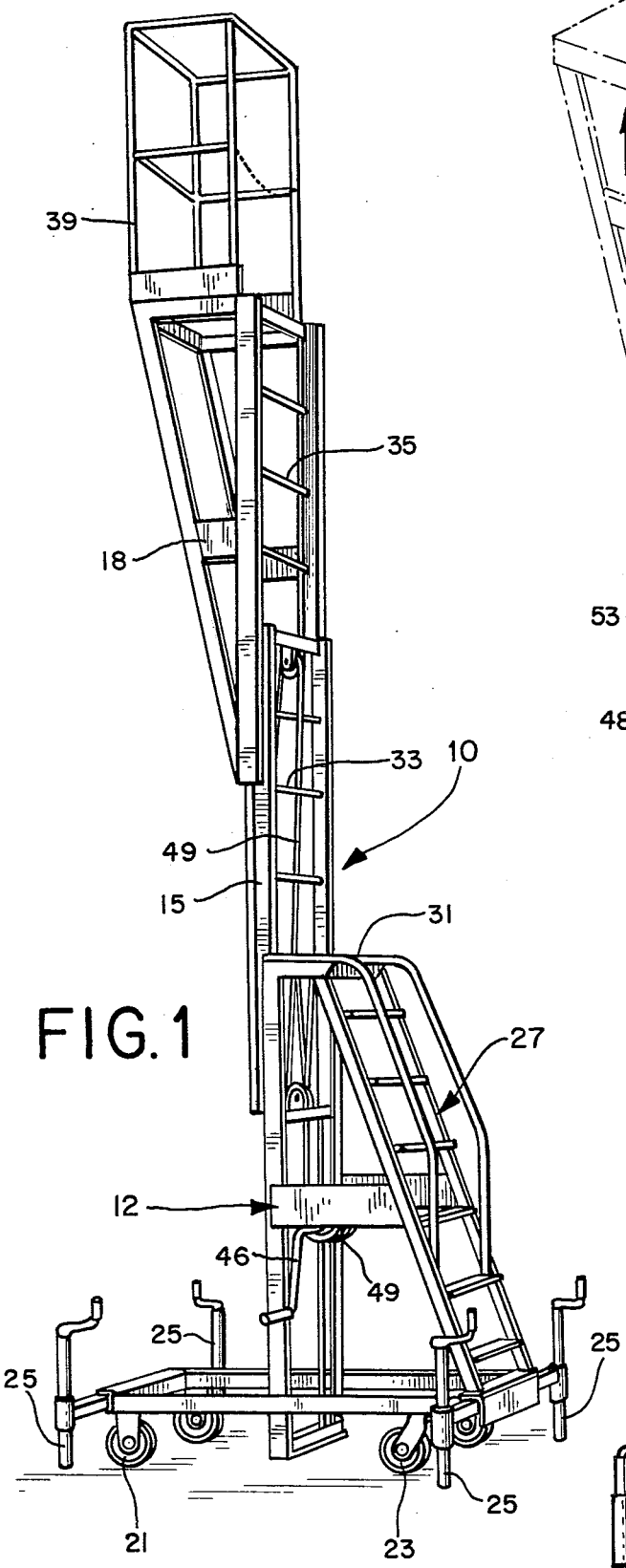
FIG. 1 is a perspective view of a fully-extended work platform that includes a locking device constructed in accordance with the present invention.

The locking device of the present invention prevents accidents caused by a premature lifting or lowering of frames of telescoping work platforms. The device includes: first locking means, second locking means, first unlocking means and second unlocking means.

As the work platform is extended from its nested position, first locking means maintains the middle frame locked to the base frame. As the platform frame approaches its fully extended position, first unlocking means mounted on said platform frame moves with the platform frame to disengage said first locking means. Substantially at the same time, the platform frame reaches a position which allows said second locking means to lock the platform frame to the middle frame. The middle frame is then raised to its extended position.

As the work platform is lowered from its extended position, said second locking means maintains the platform frame locked to the middle frame. As the middle frame approaches its fully retracted position, said second locking means comes in contact with said second unlocking means mounted on said base frame. As the middle frame is further lowered, said second unlocking means disengages said second locking means. Substantially at the same time, the middle frame reaches a position which allows said first locking means to lock the middle frame to the base frame. The platform frame is then lowered to its nested position.

Thus, the locking device assures that the lifting and lowering of frames of the telescoping work platform is accomplished in a proper sequence and prevents creation of an unstable situation by premature raising or lowering of frames.

In the preferred embodiment of the present invention the locking means comprise sliding members located in the middle frame and actuated by a spring to engage appropriate notches on said base frame and said platform frame. The unlocking means comprises cams which push the sliding means out of the notches.

DETAILED DESCRIPTION OF THE INVENTION

The automatic locking device of the present invention prevents injuries to users of telescoping work platforms resulting from "sticking" of frames of the platform. When the frames "stick" they are raised or lowered out of sequence which creates an unstable situation. The weight of the user can cause the middle frame to fall to its fully nested position. Throughout this disclosure "sticking" means that the frame due to frictional forces stops before it reaches its desired position which causes the subsequent frame to move prematurely.

When the middle frame is in a fully nested position, the locking device of the present invention automatically locks the middle frame to the base frame. As the platform frame is raised substantially to its fully extended position, the device automatically unlocks the middle frame from the base frame and locks the platform frame to the middle frame. When the work platform is lowered from its fully extended position the device maintains the middle frame locked to the platform frame until the middle frame is substantially at its fully nested position. The device then unlocks the middle frame from the platform frame. When the middle frame reaches its fully nested position the device locks it to the base frame. The platform frame is then lowered to its fully nested position. Thus, the locking device of the present invention assures that the middle frame is not prematurely raised or lowered, and thereby prevents an unstable situation which can result in the middle frame falling to its fully nested position.

The invention will now be described in connection with a preferred embodiment depicted in the drawings. Referring to FIG. 1, a work platform is designated generally by a numeral 10. The platform includes three frames: a base frame 12, a middle frame 15 and a platform frame 18. The base frame 12 includes a pair of rigid casters 21 and a pair of swivel casters 23. The casters 21 and 23 permit rolling of the platform 10 to a desired location. The base frame 12 is equipped with a set of four leveling screws 25 which, when engaged, serve a dual function of preventing rolling of the platform 10 and allowing the platform 10 to be leveled. See FIG. 2.

The base frame 12 also includes a step ladder section 27 for climbing to the flat area 31. Rungs 33 and 35, provided in the middle frame 15 and in the platform frame 18, allow the user to climb onto the railenclosed platform 39 on the top of the platform frame 18.

Figure 1A:
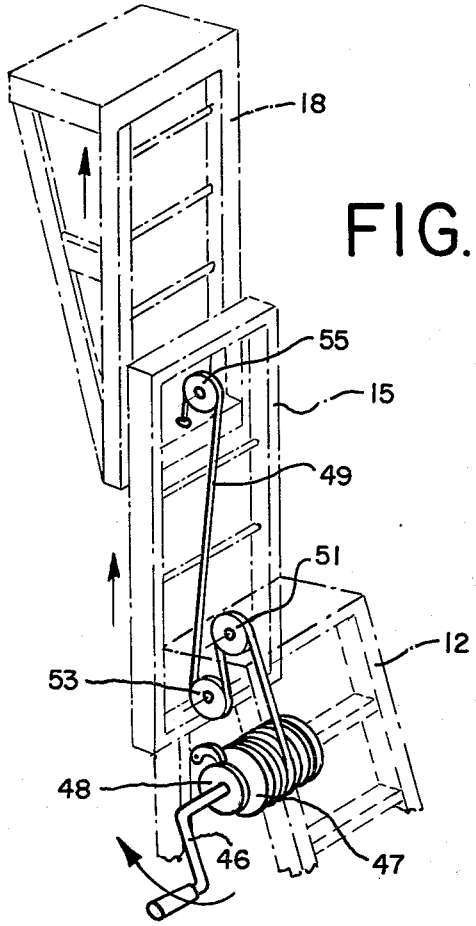
FIG. 1*a* is a partial-perspective schematic view of a hoist unit of the work platform shown in FIG. 1.

The hoist unit for the telescoping work platform 10, shown in detail in FIG. 1*a*, includes a crank 46, a drum 47 and a ratchet unit 48 which prevents the undesired rotation of said drum 47. The hoist cable 49 extends from the drum 47 through three pulleys and is anchored to the bottom of the platform frame 18. A base-frame pulley 51 rotatably mounted near the top of the base frame 12; a lower-middle-frame pulley 53 is rotatably mounted near the bottom of the middle frame 15 and an upper middle frame pulley 55 is rotatably mounted near the top of the middle frame 18.

Figure 2:
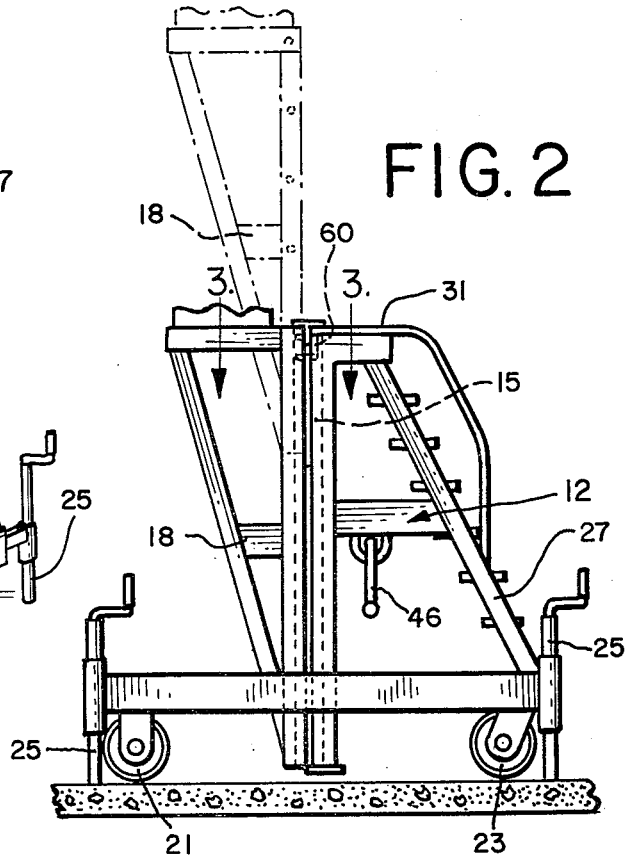
FIG. 2 is a partial side-elevational view of the work platform shown in FIG. 1 in a fully nested position and in phantom in the intermediate position.
Figure 3:
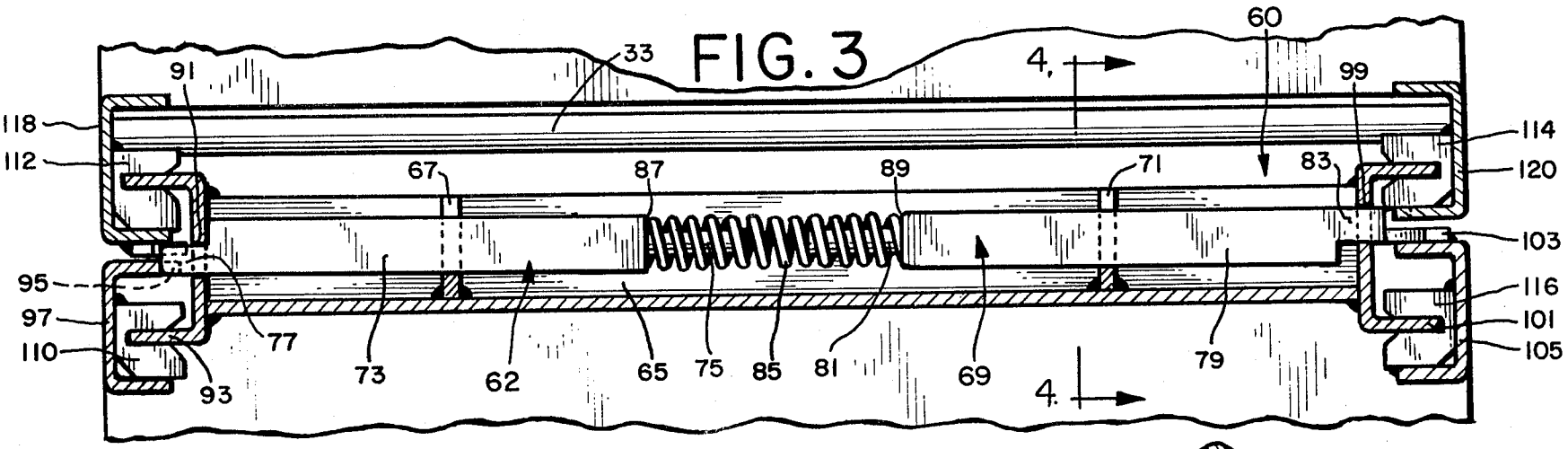
FIG. 3 is a cross-sectional view of the locking device of the platform shown in FIG. 2 taken along lines 3—3 thereof.
Figure 4:
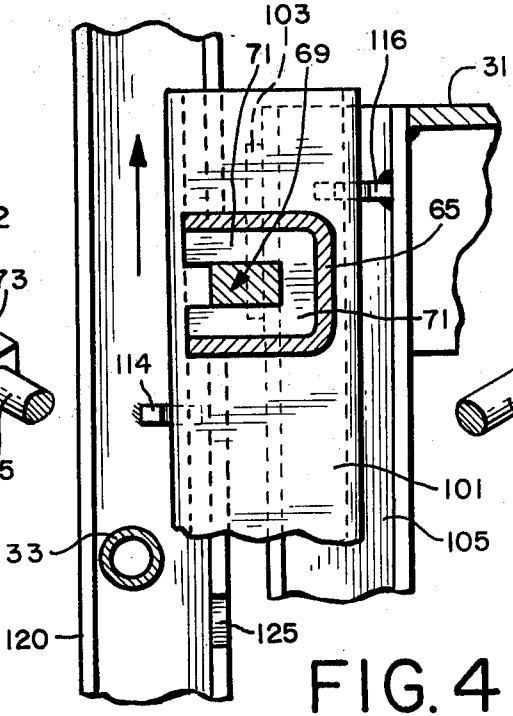
FIG. 4 is a cross-sectional view of the locking device shown in FIG. 3 taken along lines 4—4 thereof.
Figure 5:
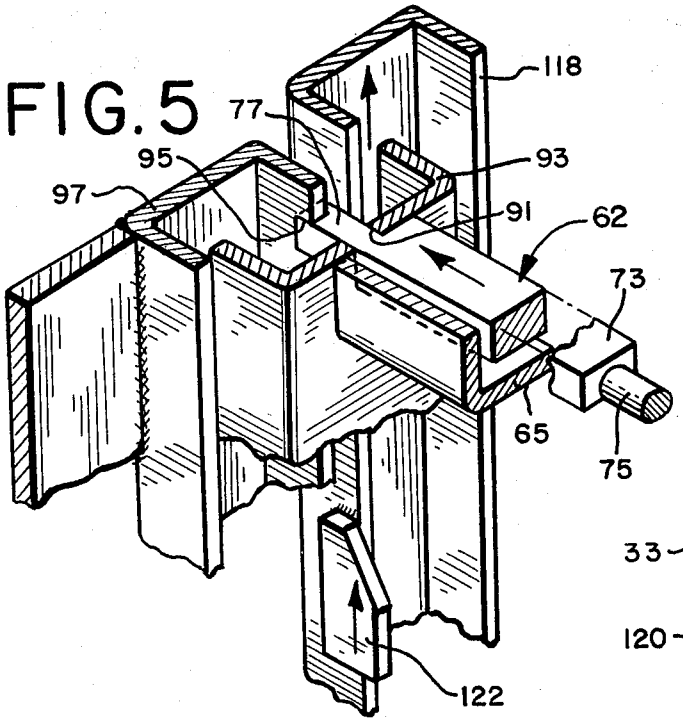
FIG. 5 is a partial-perspective view of the first end of the locking device of FIG. 3 in a locked position.

Referring now to FIG. 2, the locking device the present invention is designated generally by a numeral 60. As shown in FIG. 3, the locking device 60 includes a first member 62 slideably mounted in a channel 65 and guided by a U-shaped guide 67. A second member 69 is also slideably mounted in the channel 65 and guided by a U-shaped guide 71. As shown in FIG. 4, the U-shaped guide 71 is secured to the channel 65 and its encloses the member 69 on three sides. The member 62 and the guide 67 are mounted substantially in the same manner as the member 69 and the guide 71, shown in FIG. 4.

The member 62 includes a main section 73 having a rectangular cross section, a cylindrical section 75 at one end and a reduced section 77 at the other end. Similarly the member 69 includes a main section 79 having a rectangular cross section, a cylindrical section 81 and a reduced section 83. One end of a helical spring 85 fits around the cylindrical section 75 and rests against the end 87 of the main section 73. The other end of the helical spring 85 fits around the cylindrical section 81 and rests against the end 89 of the main section 79. As shown in FIG. 3, the reduced section 77 extends through an opening 91 in a vertical track 93 of the middle frame 15 and fits into a notch 95 in the vertical track 97 of the base frame 12. Similarly, the reduced section 83 extends through an opening 99 in a vertical track 101. FIG. 3 shows the end of the reduced section 83 being urged by the spring 85 against a second cam 103 welded to a vertical track 105 of the base frame 12.

Figure 6:
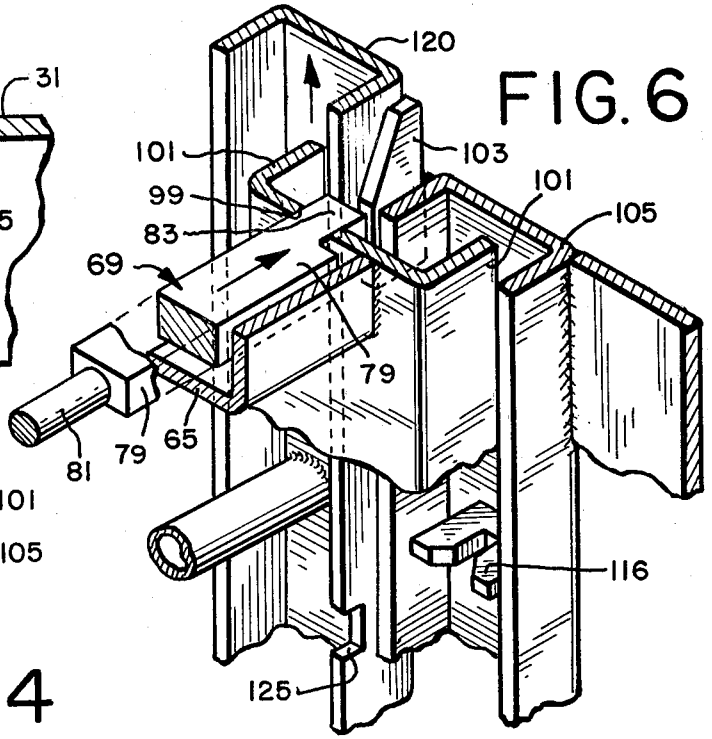
FIG. 6 is a partial-perspective view of the second end of the locking device of FIG. 3 in an unlocked position.

As shown in FIG. 3, the vertical tracks 93 and 101 of the middle frame 15 slide in slits of the guides 110, 112, 114 and 116 which are welded to tracks 97, 118, 120 and 105, respectively. Additional guides for directing the motion of the frame with respect to each other are provided in the tracks but not shown in the FIGURES. A first cam 122 is welded to the platform-frame track 118 and the second cam 103 is welded to the base-frame track 105. As shown in FIG. 6, the track 120 has a notch 125.

In operation, the work platform 10, in a nested position, is moved on rollers 21 and 23 to the desired location. In the fully nested position, the reduced section 77 extends through the opening 91 and fits into the notch 95 thereby locking the middle frame 15 to the base frame 12 as shown in FIG. 3. The reduced section 83, on the other hand, extends through the opening 99 and is urged by the spring 85 against the track 120 but in the retracted position it does not restrict the lifting of the platform frame 18.

Once the platform 10 is in the desired location the screws 25 are turned to prevent rolling of the platform 10 and to level it. The crank 46 is then rotated to reel the hoist cable 49 onto the drum 47. The cable 49 then lifts the platform frame 18 while the locking device 60 keeps the middle frame 15 locked to the base frame 12. The upward movement of the platform frame 18 is guided by guides (such as 112 and 114). As the platform frame 18 is raised, the notch 125 and the first cam 122, approach the openings 99 and 91, respectively. Once the platform frame approaches its fully extended position, the first cam 122 gradually disengages the reduced section 77 from the notch 95. FIGS. 7 and 9 show the member 73 being disengaged by the first cam 122. As the frame 18 is lifted farther, the notch 125 comes into alignment with the opening 99. When the notch 125 and the opening 99 are aligned, the reduced section 83 slips into the notch 125 and is maintained there by the force of the spring 85. At the same time the platform frame 18 comes in contact with appropriate stops on the middle frame (not shown), which prevent any further upward movement.

In the preferred embodiment shown in the drawings, the reduced section 77 is disengaged from the notch 95 about two inches before the reduced section 83 slips into the notch 125. The reason for the differential 83 is to assure reliability and provide tolerance in the location of cams and notches. It should be understood, however, that differential may be made much smaller and in fact the notch 125 can be engaged immediately after the reduced section 77 is disengaged from the notch 95.

Once the platform frame 18 reaches its fully extended position, as shown in phantom in FIG. 2, and it is locked to the middle frame 15, the further reeling of the hoist cable 49 onto the drum 47 causes the middle frame 15 to move upward with respect to the base frame 12. The vertical movement of the frame is guided by guides such as 110, 112, 114 and 116 shown in FIG. 3. The frame 15 is lifted until it reaches its desired height or until it reaches its fully extended position. The ratchet 48 is then engaged to maintain the frames 15 and 18 in an extended or fully extended position.

To lower frames 15 and 18 from their fully extended positions, the ratchet 48 is disengaged and the crank 46 is rotated to release the hoist cable 49. As the hoist cable 49 is released, the middle frame 15 is lowered. The locking device 60 maintains the platform frame 18 locked to the middle frame 15. As the middle frame 15 approaches its fully nested position, the reduced section 83 approaches the second cam 103 welded to the vertical track 105. As shown in FIGS. 6, 8, **8*a* and 9, the cam 103 disengages the reduced section 83 from the notch 125. The notch 95 then approaches the opening 91 and once they are aligned the reduced section 77 slips into the notch 95 under the force provided by the spring 85. A further rotation of the crank 46 to unreel the hoist cable 49** lowers the platform frame until it reaches its fully nested position.

In the preferred embodiment, the reduced section 83 is disengaged from the notch 125 about two inches before the reduced section 77 engages the notch 95. Again, the differential is provided for reliability and tolerance and the differential can be smaller. In fact, the reduced section 77 can engage the notch 95 immediately after the reduced section 83 is disengaged from the notch 125.

Many changes and modifications will occur to those skilled in the art upon studying this disclosure. All changes and modifications that fall within the spirit of the present invention are intended to be included within its scope as defined by the appended claims.

We claim:

1. An automatic locking device for a telescoping work platform comprising: a base frame, a middle frame and a platform frame, said device comprising:

base-locking means for automatically locking the base frame to the middle frame when said middle frame is in a fully retracted position;

base-unlocking means mounted on said platform frame for automatically unlocking said base-locking means when said platform frame is raised to a first predetermined position;

platform-locking means for automatically locking the platform frame to the middle frame when said platform frame is raised to a second predetermined position said second predetermined position being at least as high as the first predetermined position; and platform-unlocking means mounted on the base frame for automatically unlocking said platform locking means when said middle frame is lowered to a third predetermined position with respect to the base frame.

2. The device of claim 1 wherein said second predetermined position is above said first predetermined position.

3. The device of claim 1 wherein said second predetermined position is at the same height as said first predetermined position.

4. The device of claim 1 wherein said second predetermined position is sufficiently above said first predetermined position to permit said base-locking means to return to its fully unlocked position immediately before said second predetermined position is reached by said platform frame.

5. The device of claim 2 wherein said third predetermined position is reached before the middle frame is lowered to its fully retracted position.

6. The device of claim 3 wherein said third predetermined position is reached before the middle frame is lowered to its fully retracted position.

7. The device of claim 4 wherein said third predetermined position is reached before the middle frame is lowered to its fully retracted position.

8. The device of claim 1 wherein said base-locking means comprises: a first member slideably mounted on said middle frame, a first notch in said base frame for receiving said first member and spring means for forcing said first member into said first notch when said first receptacle is aligned with said first member;

said base-unlocking means comprises a first cam for disengaging said first member from said first receptacle;

said platform-locking means comprises a second member slideably mounted on said middle frame, a second notch in said platform frame and spring means for sliding said second member into said second notch when said second notch is aligned with said second member; and said platform-unlocking means comprises a second cam for disengaging said second member from said second notch.

9. The device of claim 8 wherein said spring means comprises a spring having a first and engaging the first member and a second end engaging the second member.

10. The device of claim 8 wherein said spring means comprises a first spring for sliding said first member and a second spring for sliding said second member.

11. An improved work platform comprising:

a base frame;

a platform frame;

a middle frame slideably mounted to said base frame and to said platform frame;

hoist means for lifting and lowering said middle frame and said platform frame;

base-locking means for automatically locking said base frame to said middle frame when said middle frame is in a fully retracted position;

base-unlocking means mounted on said platform frame for automatically unlocking said base-locking means when said platform is raised to a first predetermined position;

platform-locking means for automatically locking said platform frame to said middle frame when said platform frame is raised to a second predetermined position, the second predetermined position being at least as high as the first predetermined position; and platform-unlocking means mounted on said base frame for automatically unlocking said platform locking means when said middle frame is lowered to a third predetermined position with respect to said base frame.

12. The device of claim 11 wherein said second predetermined position is above said first predetermined position.

13. The device of claim 11 wherein said second predetermined position is at the same height as said first predetermined position.

14. The device of claim 11 wherein said second predetermined position is sufficiently above said first predetermined position to permit said base-locking means to return to its fully unlocked position immediately before said second predetermined position is reached by said platform frame.

15. The device of claim 12 wherein said third predetermined position is reached before the middle frame is lowered to its fully nested position.

16. The device of claim 13 wherein said third predetermined position is reached before the middle frame is lowered to its fully nested position.

17. The device of claim 14 wherein said third predetermined position is reached before the middle frame is lowered to its fully nested position.

18. The device of claim 11 wherein:

said base-locking means comprises: a first member slideably mounted to said middle frame, a first notch on said base frame for receiving said first member and spring means for sliding said first member into said first notch when said first receptacle is aligned with said first member;

said base-unlocking means comprises a first cam for disengaging said first member from said first notch;

said platform-locking means comprises a second member slideably mounted to said middle frame, a second notch on said platform frame and spring means for sliding said second member into said second notch when said second notch is aligned with said second member; and said platform-unlocking means comprises a second cam for disengaging said second member from said second notch.

19. The device of claim 18 wherein said spring means comprises a spring having a first end engaging the first member and a second end engaging the second member.

20. The device of claim 18 wherein said spring means comprises a first spring for sliding said first member and a second spring for sliding said second member.

21. In a work platform including a base frame, or middle frame slideably mounted on said base frame, a platform frame slideably mouned on said middle frame, a hoist unit for raising said work platform by lifting said platform frame to its fully extended position with respect to said middle frame, then lifting said middle frame to its fully extended position with respect to said base frame and for lowering said work platform from its extended position by lowering said work platform from its extended position by lowering said middle frame to its fully retracted position, then lowering said platform frame to its fully retracted position, the improvement comprising:

means for automatically locking the base frame to the middle frame when said middle frame is in a fully nested position;

base-unlocking means mounted on said platform frame for automatically unlocking said base-locking means when said platform frame is raised to a first predetermined position;

platform-locking means for automatically locking the platform frame to the middle frame when said platform frame is raised to a second predetermined position said second predetermined position being at least as high as the first predetermined position; and platform-unlocking means mounted on the base frame for automatically unlocking said platform locking means when said middle frame is lowered to a third predetermined position with respect to the base frame.

* * * * *

UNITED STATES PATENT AND TRADEMARK OFFICE

CERTIFICATE OF CORRECTION

PATENT NO. : 4,427,093

DATED : January 24, 1984

INVENTOR(S) : DONALD T. WEHMEYER and RONALD W. BARNHART

It is certified that error appears in the above-identified patent and that said Letters Patent is hereby corrected as shown below:

Column 4, line 6 "railenclosed" should be --rail-enclosed--

Column 4, line 19 after "device" insert --of--

Column 4, line 26 "its" should be --it--

Column 5, line 29 after "that" insert --the--

Column 6, line 67 "and" should be --end--

Column 8, line 21 "or" should be --a--

Column 8, line 23 "mouned" should be --mounted--

In the Abstract

Line 3, "," should be --.-- and "the" should be --The--

Signed and Sealed this

*Twenty-ninth* Day of *January 1985*

[SEAL]

*Attest:*

DONALD J. QUIGG

*Attesting Officer* *Acting Commissioner of Patents and Trademarks*